US005647805A

United States Patent [19]

Tarbox, Jr.

[11] Patent Number: 5,647,805

[45] Date of Patent: Jul. 15, 1997

[54] GOLF TEEING DEVICE

[76] Inventor: Robert S. Tarbox, Jr., 7732 Isabella Dr., Apt. A, Port Richey, Fla. 34668

[21] Appl. No.: 635,605

[22] Filed: Apr. 22, 1996

[51] Int. Cl.[6] ..... A63B 69/00

[52] U.S. Cl. ..... 473/137; 473/132

[58] Field of Search ..... 473/132–137

[56] References Cited

U.S. PATENT DOCUMENTS

| | | | |
|---|---|---|---|
| 1,888,256 | 11/1932 | Baumgartner | 473/137 |
| 1,952,113 | 3/1934 | Beckett | 473/137 |
| 2,285,342 | 6/1942 | MacLellan | 473/137 |
| 3,758,118 | 9/1973 | Willcox | 473/137 |
| 5,458,339 | 10/1995 | Wildes | 473/137 |

*Primary Examiner*—Steven B. Wong

[57] ABSTRACT

A lightweight and portable system to place a golf ball onto a tee. The present invention comprises a housing which has a hopper bin defined in the upper region thereof. The hopper is designed to accommodate up to four dozen golf balls at a time so that a golfer may "drive" numerous times without having to stop often and reload the hopper. Preferably, the interior of the hopper bin is sloped to form a rough funnel shape such that the golf balls are distributed one-at-a-time into a trough which is coupled to the hopper. Internal of the housing is the apparatus by which the golf balls are distributed single file through a delivery tube to the specialized ball placement mechanism. The most significant features of the present invention is the specialized ball placement mechanism which permits a golfer to tee their ball prior to driving at varying heights and the lever mechanism which allows a golfer to rapidly dispense a practice ball without drastically altering his stance or changing his grip. In particular, at the distal end of the ball placement mechanism is a pivotally connected roughly crescent shaped ball receptacle. This ball receptacle cradles the golf ball in two curved prongs or fingers.

10 Claims, 9 Drawing Sheets

GOLF TEEING DEVICE

FIELD OF THE INVENTION

The present invention concerns a device and assembly for positioning a golf ball on a tee prior to driving by a golfer. In particular, it concerns an automatic teeing device with which the golfer may dispense successive golf balls onto a tee by simply actuating a lever with his club, whereby the golfer need not greatly readjust his stance or grip between drives. The automatic teeing device of the present invention is useful for increasing the efficiency of a golfer's practice time, is easy to install, easy to manufacture easy to operate, portable and sturdy.

DESCRIPTION OF THE RELATED ART

In addition to the putt, which is the specialized stroke used on the green, there are two types of shots used in playing each golf hole. The first type is the drive which is a long shot from the tee onto the fairway, and the second is the approach shot to the green. Both the drive and the approach shot demand great accuracy. Generally, a standard set of golf clubs contains 14 clubs. Each club is designed for a specific type of shot, according to the distance to be covered and the lie (position) of the ball. For making drives and distance shots on the fairway, the woods and "long" irons are used. For the initial drive of each hole, the ball is "teed up", that is, placed on a small wooden, rubber, or plastic peg known as a tee. The tee lifts the ball approximately one-half inch off the ground, allowing the head of the club to strike the ball without hitting the ground.

Golf magazines and instructors often emphasize that practice (particularly at a driving range) is one of the most important variables for improving ones golf shot, particularly the drive and the approach shot. See for instance, Meg Mallon, *Hit More Greens: The keys are preparation, swing plane and practice, GOLF DIGEST*, June, 1995, at 68–71. In particular, the goal of a practice session should be to repetitiously use the same swing and consistently hit the same kinds of shots, time after time. The focus of the golfer while at the practice tee should be on his swing, particularly analyzing the consequence of altering his swing plane, stance and grip. The golfer should not have to be distracted by the task of teeing up successive golf balls.

Historically, golfers have utilized fixed teeing locations to practice and improve their golfing skills. A current practice when a golfer wishes to refine his golf stroke, most often used at commercial driving ranges, is for the golfer to purchase a bucket of balls and then methodically place a golf ball onto a tee and take a practice stroke. Repeating this process over and over in rapid succession is not only tedious and disruptive of the learning process, but constantly stooping over can place a strain on a golfer's back, potentially causing injury. Once a golfer is tired or sore it is unlikely that he will continue to take practice shots and as a result his golf game may suffer.

There is a need for improving the method by which a golfer tees up his golf ball so that the golfer may rapidly tee up successive balls without having to greatly alter his stance or hand position on the grip of the club.

Given the importance of a good golf swing and a strong drive to success in the sport of golf, numerous attempts have been made over the years to perfect a teeing device which mechanically places a ball onto a golf tee for a golfer to strike. Generally speaking, these devices have either been for installation below ground or utilize an above ground approach. However, devices utilizing either of these approaches have additional inherent drawbacks which have prevented their acceptance in the golf industry.

Teeing devices which are installed below ground are often mechanically and electronically complex and require excavation prior to their installation. For instance, U.S. Pat. No. 5,352,964 (Kruger) teaches an underground system where a photoelectric sensor detects movement of the tee (i.e. once the golfer swings and displaces the ball), whereupon the tee is retracted below ground by an electric motor driving a pinion gear and a replacement ball is gravity fed onto the tee at its lower most retracted position. The height to which the tee will rise is adjusted by use of a height adjustment micro switch. Additionally, U.S. Pat. No. 5,356,148 (Elder, Jr.) teaches an underground trough which receives golf balls from a hopper and a pneumatic device which raises the tee to a position higher than ground level. The patents to Kruger, Elder, Jr. and Dermott all teach teeing devices where the ball is automatically teed after the shot. These devices are complex, prone to breakdown and difficult to repair.

Similarly, teeing devices which are located above ground are often mechanically complex, require electric power and do not allow the golfer to vary the height of the ball placement. U.S. Pat. No. 4,796,893 (Choi) teaches a portable golf teeing device which internally has a means for separating golf balls including several support means with parallel outer blades rotatably attached to the shaft and a gear mechanism. A golf ball is placed onto a tee utilizing a cup member and ball guide where the outer end of the ball guide has the center portion removed to describe a hole of a diameter that is slightly larger than the diameter of the golf ball. The device of Choi requires the golfer to utilize his foot to press a lever to dispense the next golf ball. This mandatory change in stance is disruptive of the learning process.

Additionally, U.S. Pat. No. 4,957,296 (Turnidge et al.) teaches a golf ball teeing device where upon activation of the golf ball release and transfer assembly a golf ball follows a downward sloping guide track defined in a pivot arm assembly to be deposited centered upon a tee. The device of Turnidge et al. utilizes a pulley-spindle assembly to move the pivot arm which may lose its integrity under repetitious use conditions. Additionally, due to the orientation of the positioning and centering device, and the opening defined in the pivot arm there is no means whereby a golfer can vary the height of the tee.

U.S. Pat. No. 5,464,233 (Dermott) teaches a device for teeing a golf ball automatically. The device of Dermott utilizes a complex guide, lane blocker, rotor and pendulum system to release one ball at a time from the hopper. Additionally, the invention of Dermott employs a rod adjoining the tee such that once a golfer swings and displaces the tee another golf ball is automatically dispensed.

All of the above-mentioned dispensers and teeing devices suffer from disadvantages which limit their usefulness and applicability to the present need. Specifically, they do not allow a golfer to adjust tee height or selectively tee a ball. The devices of the prior art are mechanically complex, difficult to assemble and use and expensive. For the foregoing reasons, there is a need for a low cost, simply constructed, portable device to automatically place a ball on a tee of adjustable height prior to a golfers' stroke.

SUMMARY OF THE INVENTION

In view of the foregoing disadvantages inherent in current golf ball dispenser and teeing devices, specifically the absence of an automatic teeing device which allows a player to dispense a golf ball without a significant change in his stance, it is an object of the present invention to provide an automatic teeing device which allows a golfer to selectively dispense a golf ball onto a height adjustable tee by simply depressing a lever.

It is a further object to provide a method and apparatus to conveniently and automatically position a golf ball so that it can be hit with a golf club, during practice, by a golfer at a driving range, at home, or any desired location.

It is a further object to provide a teeing device which may be activatedby a golfer, utilizing a golf club, without requiring a golfer to greatly alter his stance or grip. By permitting a golfer to readily tee golf balls in rapid succession the present device allows the golfer to concentrate on the mechanics and rhythm of his swing. Specifically, the golfer does not have to repeatedly reach or stoop downward to retrieve a golf ball off the ground or out of a bucket.

It is a further object to provide a teeing device which is equally effective when utilized by a right or left-handed golfer.

It is a further object to provide a teeing device which allows a golfer to have a consistent pre-shot routine.

After extensive investigation and experimentation, the present inventor has found that these and other objects are accomplished by providing a sturdy lightweight housing with a base and rear support, a hopper, and a ball placement mechanism which is engaged by depressing a lever.

A significant feature of the present invention resides in the use of a specialized ball placing mechanism. Preferably, the ball placement mechanism comprises a pivotally hinged roughly crescent shaped ball receptacle to permit the ball to be reliably placed onto a tee of varying heights.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other golf ball teeing devices for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

Further objectives and advantages of the present invention will become apparent from a careful reading of the detailed description provided hereinbelow, with appropriate reference to the accompanying drawings.

DETAILED DESCRIPTION OF THE INVENTION

Figure 1:
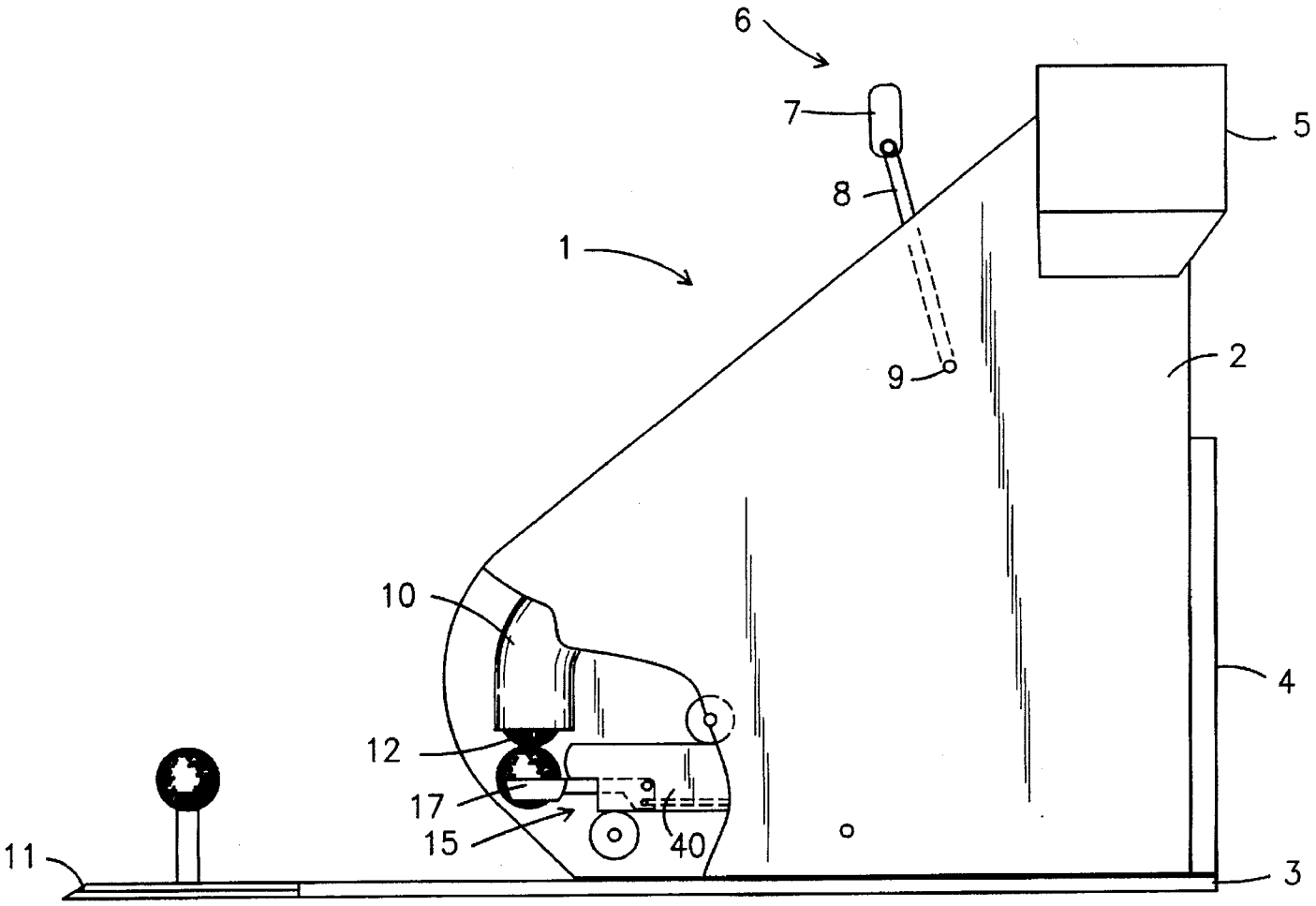
FIG. 1. is a side view of a golf tee device according to the invention illustrating the external housing and a cut-away view showing the lower portion of the ball delivery tube

After extensive investigation, the present inventor has discovered that a reliable and portable system to automatically place a golf ball onto a tee may be constructed by incorporating a specialized ball placement mechanism into a ball delivery system. More particularly, the present invention comprises a housing which has a hopper bin defined in the upper region thereof. The hopper is designed to accommodate up to four dozen golf balls at a time so that a golfer may "drive" numerous times without having to stop often and reload the hopper. Preferably, the interior of the hopper bin is sloped to form a rough funnel shape such that the golf balls are distributed one-at-a-time into a trough which is coupled to the hopper.

Internal of the housing is the apparatus by which the golf balls are distributed single file through a delivery tube to the specialized ball placement mechanism.

The golf teeing device of the present invention may incorporate any of the design features, operating layouts, materials, and hardware of any presently available golf devices for the housing, hopper, delivery tube, base material, mat material and internal slide mechanism hardware. These components may be any of those conventionally available including those disclosed in U.S. Pat. Nos. 5,356,148, and 5,464,223. The disclosures of these patents with regard to conventional arrangements and hardware is expressly incorporated herein by reference.

The most significant features of the present invention is the specialized ball placement mechanism which permits the golfer to tee his ball prior to driving at varying heights and the lever mechanism which allows the golfer to rapidly dispense a practice ball without drastically altering his stance or changing his grip. In particular, at the distal end of the ball placement mechanism is a pivotally connected roughly crescent shaped ball receptacle. This ball receptacle cradles the golf ball in two curved prongs or fingers.

When a golfer wishes to dispense a golf ball onto a tee, the golfer first positions the golf tee into a slot defined in the base, and preferably through a mat provided on the base, of the automatic teeing device. The tee may be manufactured of rubber, plastic, wood or any material known in the art but is preferably a "standard" rubber range tee. Standard rubber range tees are designed to withstand repeated strikes, are manufactured in varying heights and are less prone to being pitched from the golf tee device. An advantage in this approach, over a tee integral with the device, is that a golfer may "tee-up" to varying heights (usually between ½ inch to 1¾ inches) to replicate the particular type of golf shot he wishes to practice and allows for the use of conventional tees rather than a specialized tee.

Preferably the golf tee device of the present invention is provided with a mat which is sized such that it surrounds the tee and serves to protect both the base of the teeing device and the golfer's club in the event of a mistrike. The mat may be of varying dimensions and may be manufactured of any material known in the golf art such as rubber or plastic.

In an alternative approach, the mat may be provided with a plug such that the golfer may remove the tee and hit a golf ball directly off the mat.

Alternatively, the golf teeing device of the present invention may be freestanding and the tee inserted into the ground, thereby allowing an individual to practice his stroke on real turf.

When a golfer is prepared to hit a golf ball he simply extends the distal end of his golf club and pushes on the external primary lever thereby "activating"/extending the ball placement mechanism. The primary lever consists of a pedal joined to a lever arm. Preferably, the pedal is manufactured of or covered by a non-scratching material to protect the golf club head. Because the teeing device of the present invention allows the golfer to selectively tee-up a golf ball (i.e. by actuating the lever mechanism), without necessitating a change in stance, the device allows the golfer to develop a pre-shot routine which enhances shot alignment and rhythm. In fact, some golf instructors teach the golfer to take a stance behind the ball, address and make a full practice swing prior to hitting the shot. However, once a golfer is "in a groove" the teeing device of the present invention will also allow a golfer to rapidly and effortlessly tee-up a dozen or more balls in a row and hit them one after the other without interruption in concentration thereby reinforcing positive habits.

As a further refinement to the present invention the hopper may be provided with a hinged or removable lid (not shown) such that the device of the present invention may remain outside without risk of corrosion to the internal mechanisms. Similiarly, at the point where the primary lever extends from the housing, the device of the present invention may be provided with a flexible plastic or rubber material to protect the internal mechanisms against the elements. Preferably, the housing and hopper are constructed of aluminum, high-density polyethylene, polypropylene, ABS Resins (composed of acrylonitrile, butadiene, and styrene) or any lightweight, strong and non-corroding material. Preferably, the base and rear support are manufactured from aluminum, high-density polyethylene, polypropylene, ABS Resins (composed of acrylonitrile, butadiene, and styrene) or any lightweight, strong non-corroding material.

As a further refinement to the present invention the golf tee device may be provided with a handle (not shown) to aid a golfer in moving the device of the present invention.

Preferably, the golf teeing device of the present invention is portable, lightweight and may be stored in a relatively small space. More preferably, the device weighs between 5 and 10 pounds, and has external housing dimensions of 12 inches wide by 10 inches long (excluding the tee pad) and 12 inches high.

Generally, the tee slot defined in the base will be 6 to 8 inches from the housing of the golf device.

Preferably, the device of the present invention can be conveniently and releasably installed in any practice station of a golf ball driving range or for use at home with a ball capture net.

Alternatively, the golf tee device of the present invention may be permanently installed using bolts or any securing mechanism known in the art in a practice station of a golf ball driving range. The base and mat of the present invention can be readily modified for insertion into existing driving range station ground coverings.

A further advantage of the present invention over the prior art pertains to its adaptivity to accommodate either right or left handed golfers.

Ideally, the golf teeing device of the present invention is oriented such that it lines up perpendicularly to the stance of the golfer. This orientation allows a golfer, right or left handed, to stand square as they address the ball and still readily reach and depress the primary lever with the distal (head) end of their club. In order to permit the customized positioning of the golf teeing device of the present invention and use by either a right or left handed golfer, the external primary lever is located medially within the external housing.

In an alternative embodiment, the golf teeing device does not incorporate an extended base with a slot defined therein for placement of a tee. However, a golfer may readily determine the proper distance for placing the teeing device by actuating the primary lever and inserting the tee to the local indicated by the ball placement mechanism in its fully extended position.

The device and system according to the present invention will now be discussed in greater detail by reference to the drawings. FIG. 1 illustrates a golf teeing device i at rest, generally having an external housing 2, a base 3, a mat 11 with a slot defined therein (not shown) for placement of a golf tee and a rear support 4 oriented perpendicularly to said housing (see particularly FIG. 7). Additionally, the golf teeing device has a hopper 5 for the storage and supply of golf balls, an external primary lever 6 and a ball delivery tube 10 (shown in cutout). The housing 2, has an opening defined therein (not shown) through which the primary lever 6 extends. The primary lever 6 is comprised of a pedal 7 which is joined to a lever arm 8 and rotates within an upper guide bearing surface 9. The ball delivery tube is installed at an incline so that the golf ball(s) 12 will feed by gravity from the hopper to the ball placement mechanism 15. When a bucket of balls is deposited into the hopper the balls exit through an opening defined in the lower portion of the hopper and travels through the ball delivery tube. The ball delivery tube 10 is angled slightly to the horizontal with a first end connected to the hopper being higher than the second end which feeds into the ball receptacle 17. The ball delivery tube 10 is preferably cylindrical and has an inside diameter slightly larger than a standard golf ball (for instance the delivery tube can be manufactured from a 2" standard PVC pipe). Thus, the golf balls feed into the ball delivery tube in single file and stack into the delivery tube prior to being released into the crescent-shaped ball receptacle 17.

Figure 2:
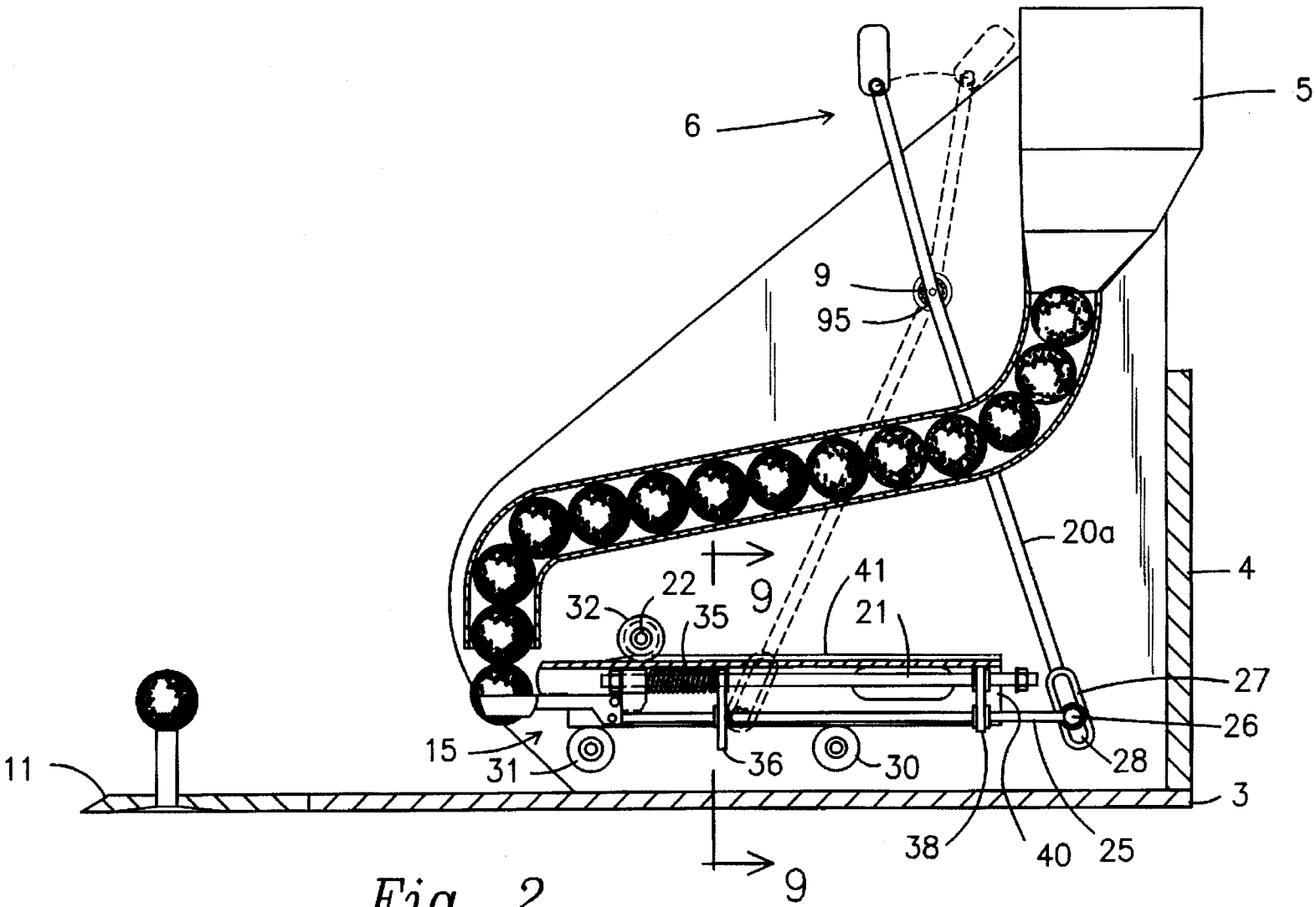
FIG. 2 is a cross sectional view of a golf tee device according to the invention with solid lines representing the rest position of the primary lever and secondary lever and broken lines representing the operating position.

FIG. 2 illustrates the internal mechanism of the golf teeing device. Upon the actuation of the primary lever 6, the secondary lever, which is operatively associated with the primary lever, branches into arms 20*a* and 20*b* (only one of which is shown in FIG. 2) at fulcum 29. The secondary lever rotates about an upper guide bearing surface 9 and acts upon a first elongate member 25. The secondary lever serves as the driving mechanism for the ball placement mechanism 15. Specifically, upon actuating the primary lever 6, the primary lever pivots from a first position to a second position thereby causing the secondary lever to impel the ball placing mechanism 15 forward. The secondary lever 20 and first elongate member 25 are coupled by a pin and slot joint 27. The pin 26 is preferably formed integral with the first elongate member and is freely movable within a slot 28 formed integrally in the distal end of the second lever.

The ball placement mechanism is actuated by a biasing member or spring 95 which generates the rearward movement of the ball placement mechanism 15, by drawing back the primary elongate member 25. A spring shock absorber 35 is located on a second elongate member 21. The spring biasing means 95 may be of any construction capable of storing tension or torsional energy as return energy, but preferably comprises a metal spring member in the shape of a helical coil, coiled about an axis. The spring means may be made of any suitable resilient material, and is preferably made of metal, but may be any other spring means such as an elastic cord such as a bungee type elastic cord. As the primary lever is depressed, the spring biasing means 95 is wound, creating a restoring torsional force which withdraws the ball placement mechanism 15 to the rest position.

Figure 6:
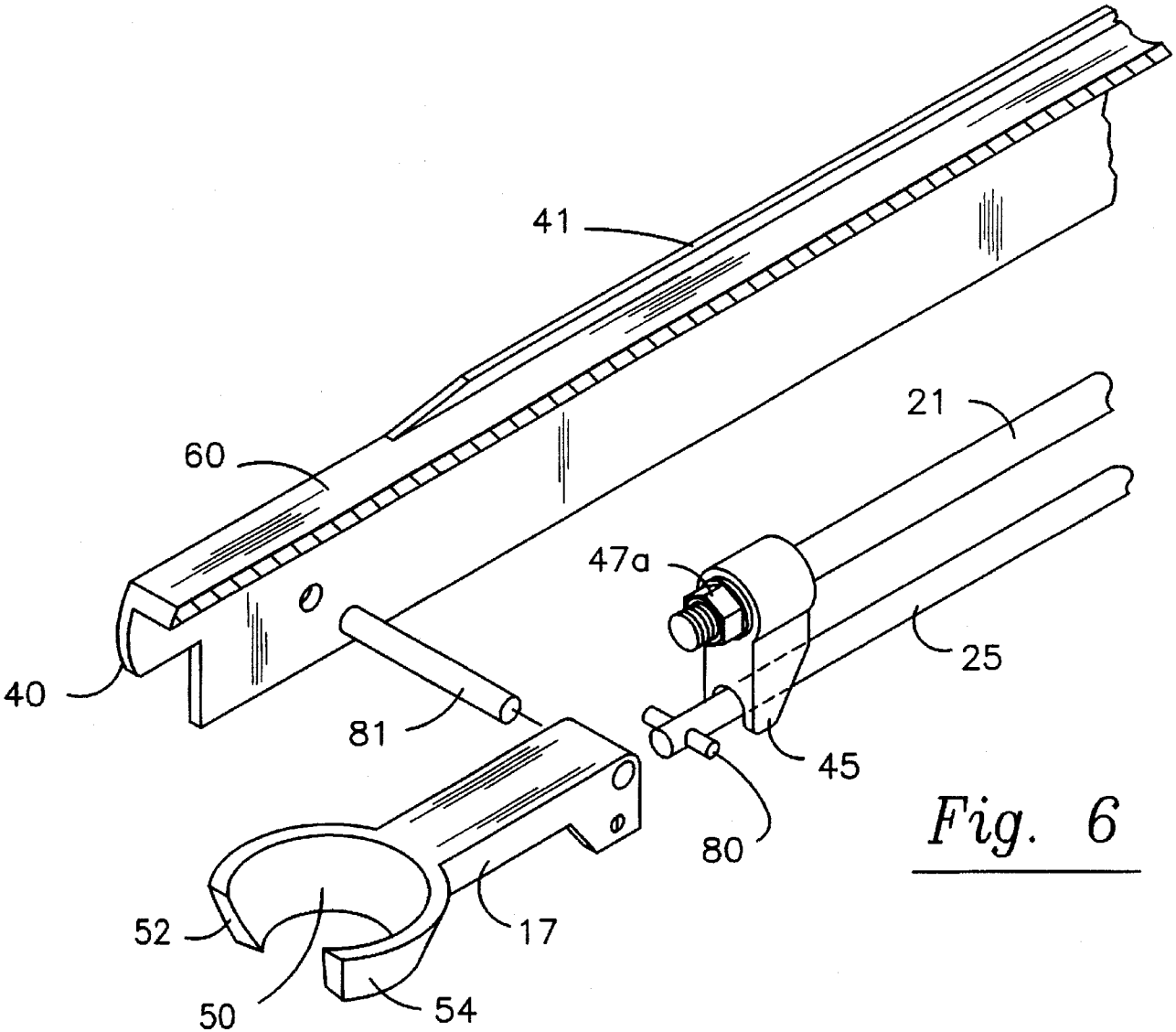
FIG. 6 is an elevated front view of the specialized ball receptacle illustrating its attachment to the ball placement mechanism and the cupped prongs of the ball receptacle which cradle the golf ball.

The first and second elongate members are housed within a C-shaped channel 40 (which is shown in a non cut-away view in FIG. 1 and cross sectional view in FIG. 6). There is a groove 41 defined in the top most part of the channel 40. This groove engages behind a top guide wheel 32 and serves to maintain the ball placement mechanism in-line. The guide wheels (30, 31, and 32) are affixed to the external housing 22 by a bolt, rivet or any hardware known in the art. The two lower guide wheels (30 and 31) support the ball placement mechanism while the top guide wheel 32 serves as a guide and counter-balance. In order to maintain the spatial relationship between the first and second elongate members two stop guides (36 and 38) are slidably mounted upon the elongate members.

Figure 3:
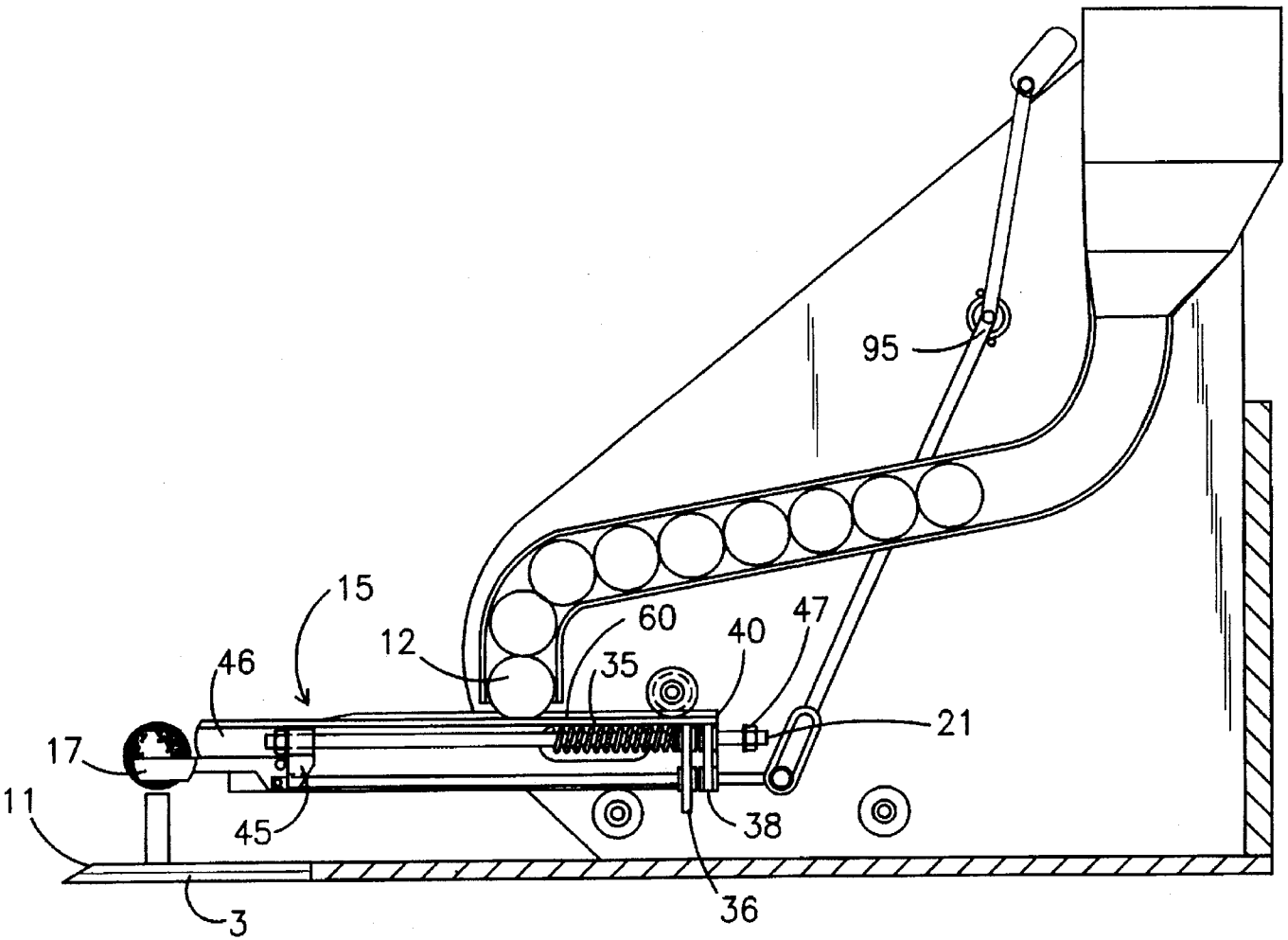
FIG. 3 is a cross sectional view of the golf tee device according to the present invention with the ball placement mechanism extended to the teeing position.

FIG. 3 illustrates the ball placement mechanism 15 as it moves outward toward the tee. The channel 40 is constructed with a solid cover 60 such that when the ball placement mechanism is transferring a golf ball toward the tee the cover 60 serves as a stop to prevent additional golf ball(s) 12 from dispensing from the ball delivery tube 10. As the secondary lever moves from its at rest position the spring biasing means 95 is wound and the stop guides 36 and 38 come into close proximity. Located on the proximal end of the second elongate member 21 is a block 47 which serves to maintain stop guide 38 in proper placement. A second block **47*a* is located at the distal end of the second elongate member. At the distal end of the ball placement means 15 are a stop retainer 45 and a bridge 46 which aid in orienting the crescent shaped ball receptacle 17**.

Figure 4:
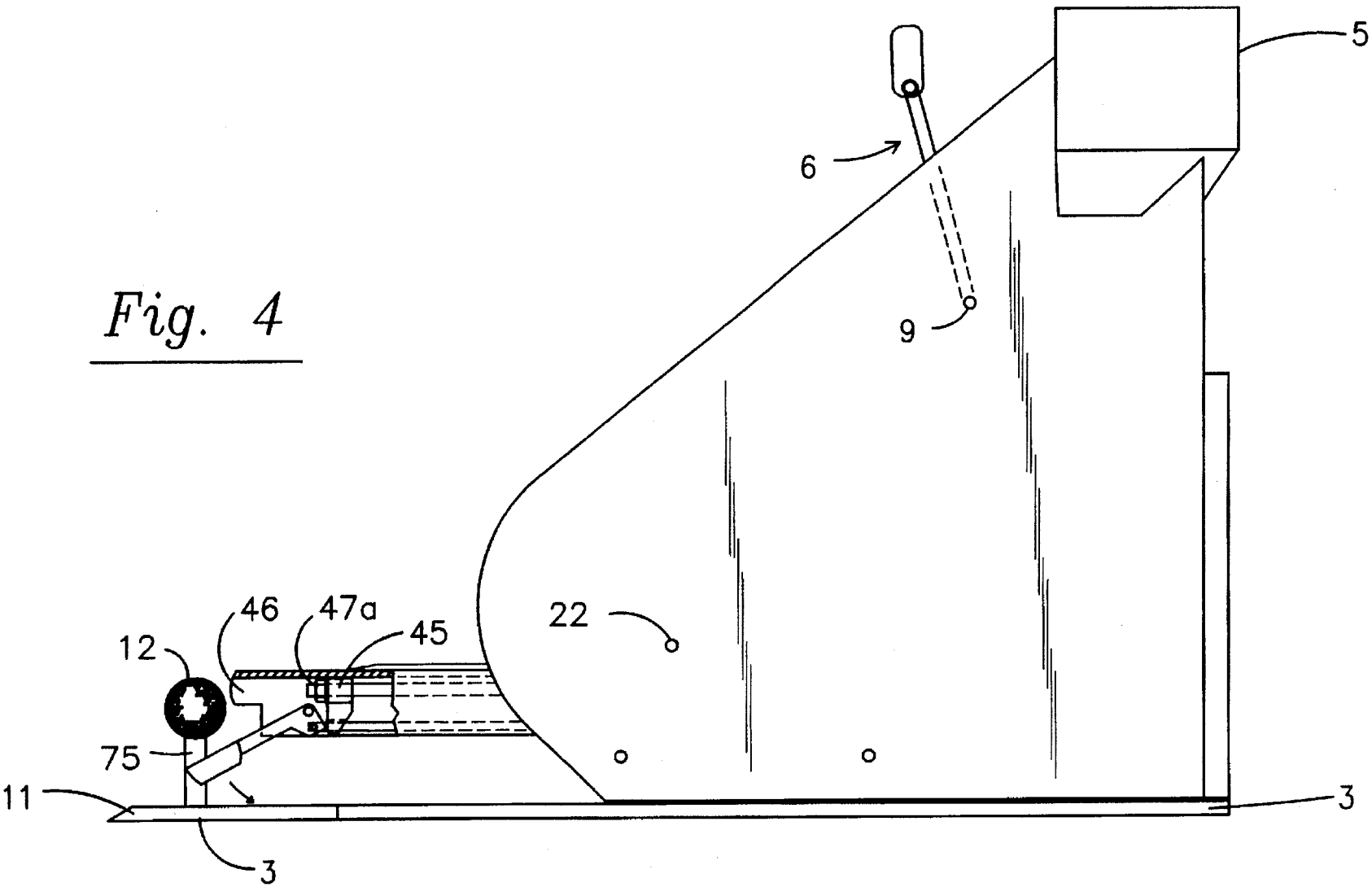
FIG. 4 is a cross sectional view of the device of the present invention illustrating the ball placement mechanism beginning to retract.

FIG. 4 illustrates the placement of the golf ball 12 onto a tee 75, which is positioned within a slot (not shown) defined in the protective mat 11. Specifically, as the ball placement mechanism moves beyond center of the upper guide bearing surface 9 and is fully extended the spring biasing means begins to retract the ball placement mechanism. This rearward motion causes the crescent shaped ball receptacle 17 to pivot downward and dispense the golf ball onto the tee 75.

Figure 5:
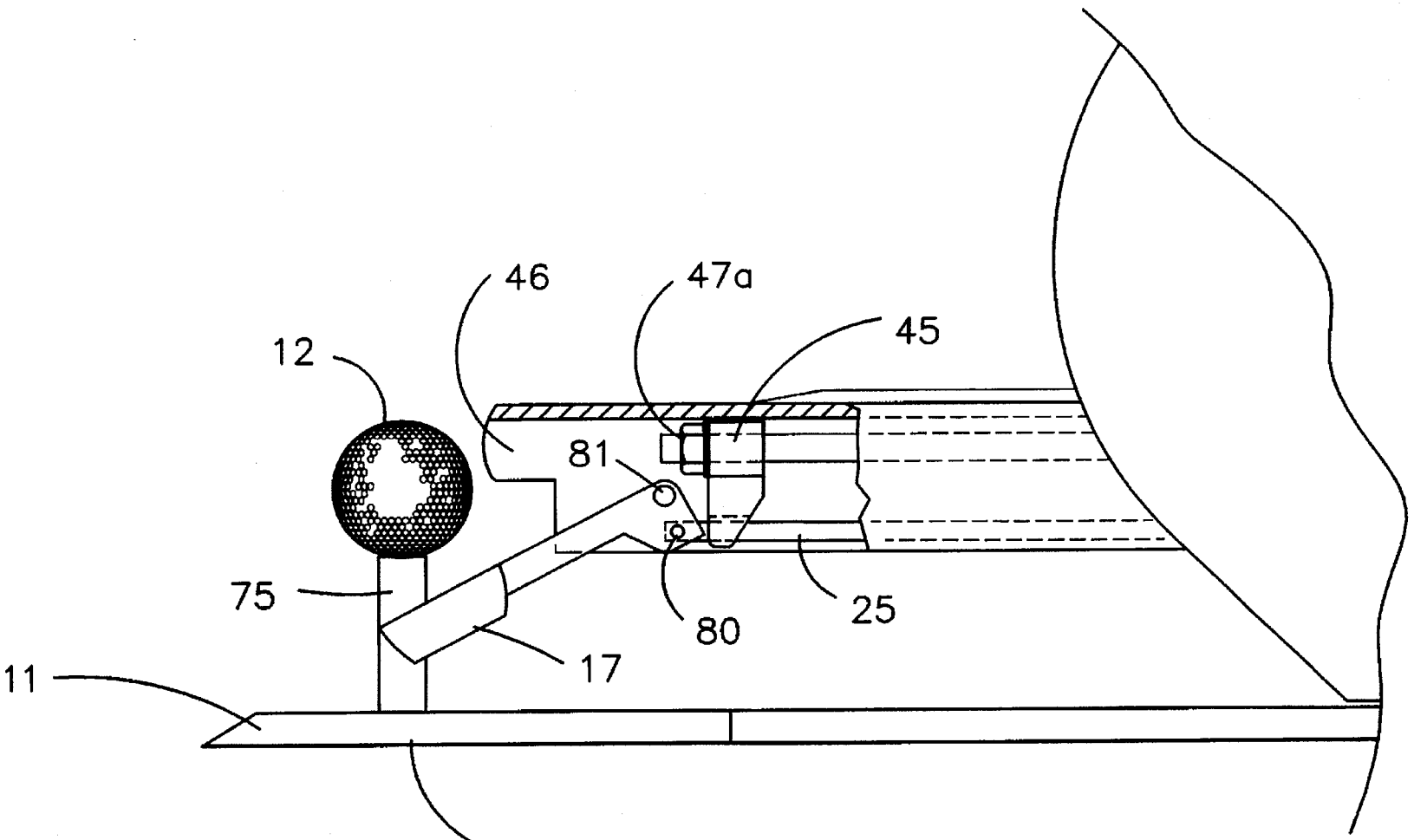
FIG. 5 is a cross sectional slightly more detailed schematic view of the specialized ball receptacle.

FIG. 5 illustrates in greater detail the ball receptacle 17 which is pivotally hinged 80 at the distal end of the first elongate member. As the first elongate member pulls back, and hence the ball placement mechanism, the combination of gravity and the rearward motion of the first elongate member causes the ball receptacle to rotate downward about an upper fixed pivot point 81 mounted through the C-shaped channel 40 and disengages from the golf ball thereby placing the golf ball upon the tee.

FIG. 6 is a cut away perspective view of the C-shaped channel 40, through the solid top portion 60. The ball receptacle 17 is shown in detail, including the mechanism by which the receptacle articulates downward to release a golf ball onto a tee. Specifically, the ball receptacle is pivotally coupled 80 to the first elongate member (this pivot may be formed integral with the first elongate member or be a pin therethrough) such that rearward horizontal movement by the first elongate member, together with gravitational force, causes the ball receptacle to pivot about an upper fixed pivot point 81 coupled to said C-shaped channel.

One of the unique features of the golf tee device of the present invention, which permits a golfer to utilize golf tees of varying heights, is a ball receptacle 17 with a crescent shaped ball cup 50 at its distal end. The ball receptacle may be manufactured as a single uniform piece with the ball cup formed integral therewith. Alternatively, a crescent shaped ball cup 50 can be coupled at the distal end of a ball receptacle.

A golf ball (not shown) rests in the ball cup 50, after it is dispensed from the hopper through the ball delivery tube, as the ball placement mechanism moves horizontally towards the golf tee. Specifically, the ball cup 50 is formed in a roughly semi-circle or crescent shape with a space defined therethrough. The outer ends of the ball cup form two prongs 52 and 54 which encircle and cradle the golf ball.

Figure 7:
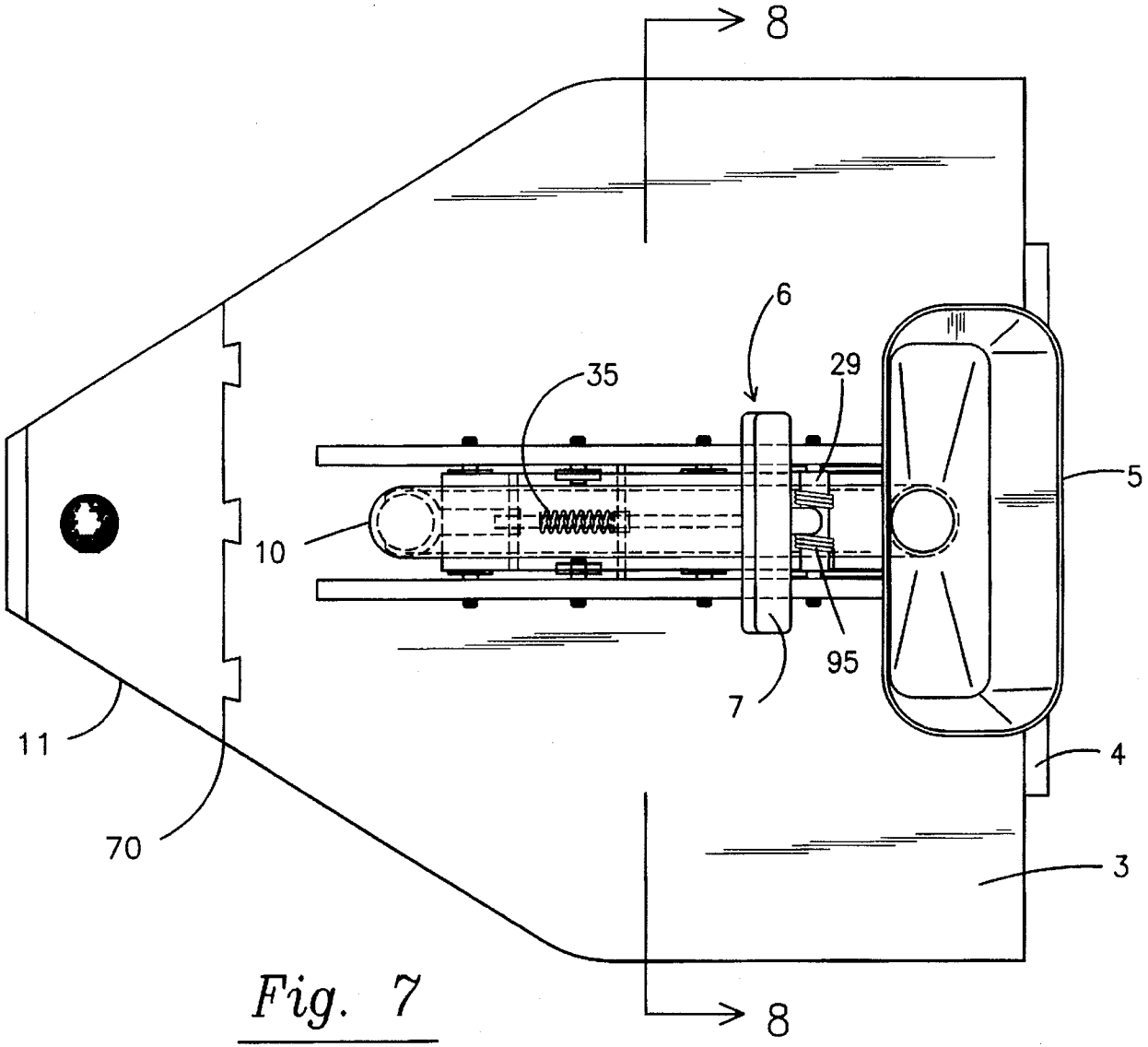
FIG. 7 is a top view of the golf tee device of the present invention.

FIG.7 is a top view of the golf tee device of the present invention. The mat 11 which surrounds the tee is joined with the base 3 of the golf tee device by means of a dove-tail joint 70.

Figure 8:
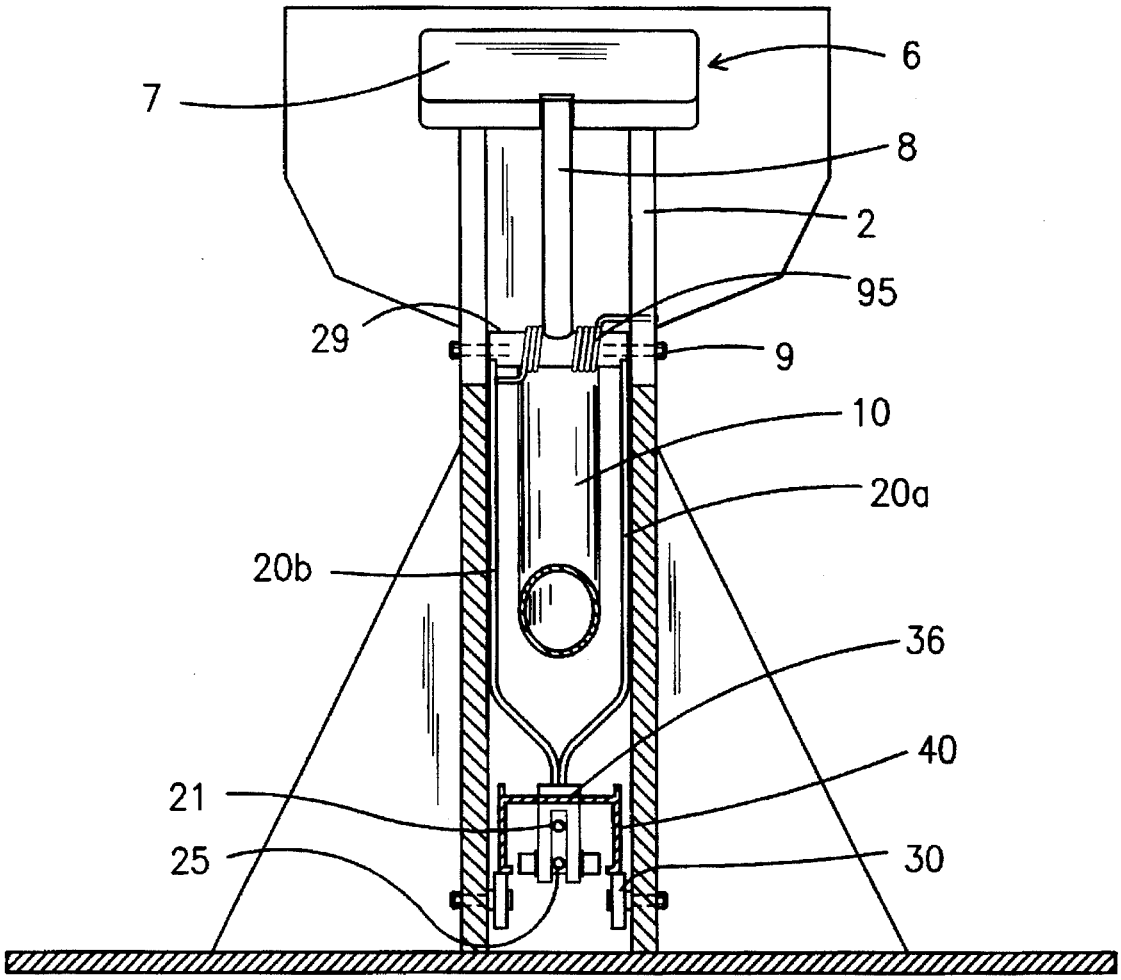
FIG. 8. is a sectional view of the golf tee device taken across the line 8—8.

FIG. 8 is a sectional view illustrating the orientation of the internal actuating mechanism. As illustrated, the primary lever 6 extends through the housing 2 roughly at the centerline of the housing. When a golfer wishes to dispense a golf ball he simply extends his club, pushes on the pedal 7 located on topmost portion of the lever arm 8, thereby actuating the primary lever 6. As the primary lever pivots from a rest position to an operating position, the secondary lever, which branches into arms **20*a* and 20*b* at fulcrum 29, rotates about an upper guide bearing surface 9 and acts upon a first elongate member 25 and serves as the driving mechanism for the ball placement mechanism 15. Specifically, upon actuating the primary lever 6, the primary lever pivots from a first position to a second position thereby causing the secondary lever to impel the ball placing mechanism 15 forward. The secondary lever 20 and first elongate member 25 are coupled by a pin and slot joint 27**.

Figure 9:
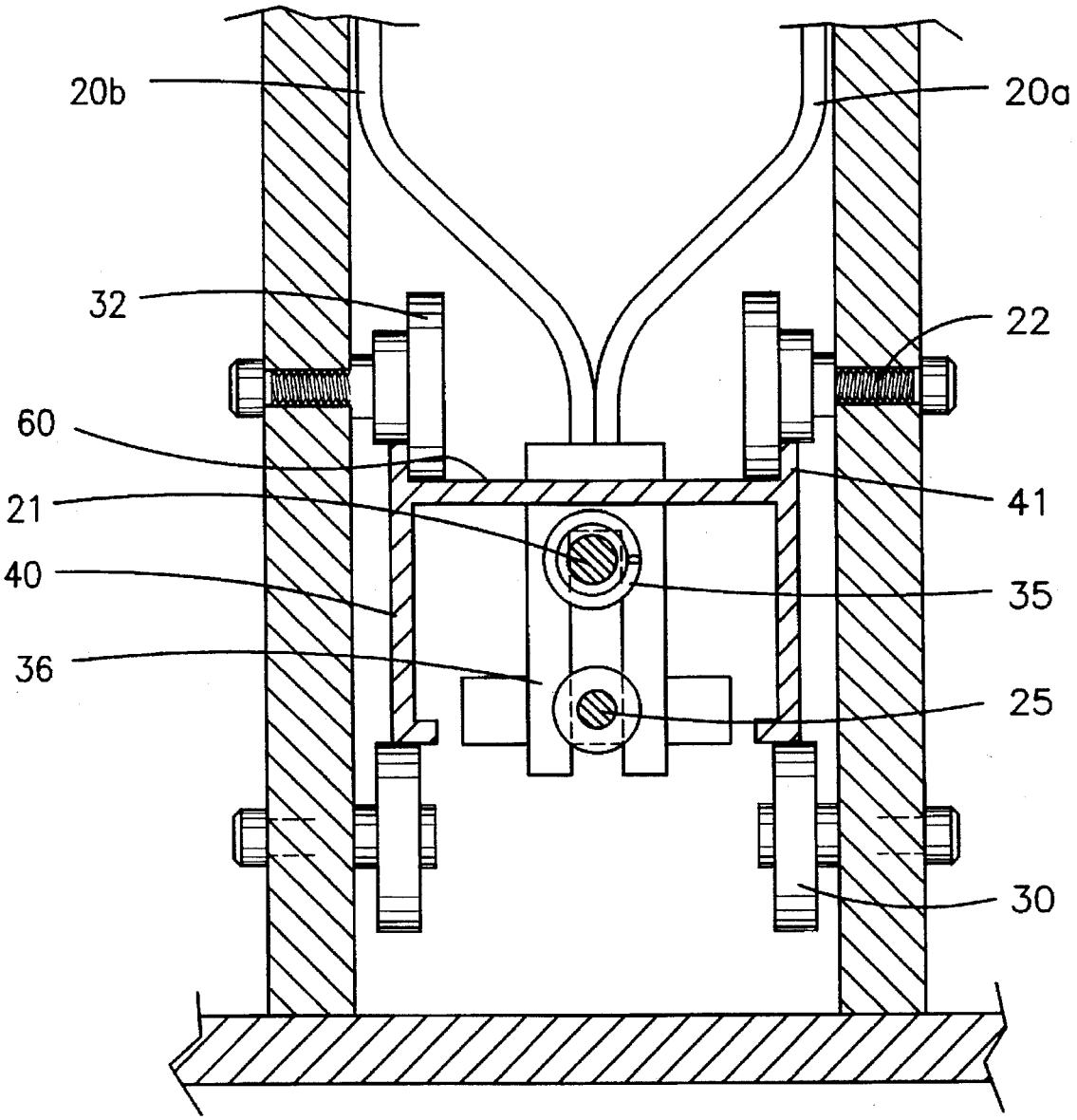
FIG. 9. is a sectional view of the golf tee device taken across the line 9—9.

FIG. 9 illustrates an exploded sectional view illustration the first and second elongate members (25 and 21) and stop guide 36. In order to maintain the spatial relationship between the first and second elongate members two stop guides (36 and 38) are slidably mounted upon the elongate members. Each stop guide 36 and 38 (not shown) has two bushings defined therethrough. Preferably, each of these bushings is lined with TEFLON or other suitable anti-friction material to enhance the slidableness of the first and second elongate members upon actuation of the primary lever. FIG. 9 further illustrates the orientation of the C-shaped channel within the housing of the golf tee device. Specifically, there is a groove 41 defined in the top most part of the channel 40. This groove engages behind the top guide wheel 32 and serves to maintain the ball placement mechanism in-line. The guide wheels (30, and 32) are affixed through the external housing 22 by a bolt, rivet or any hardware known in the art. The two lower guide wheels (30 and 31) support the ball placement mechanism while the top guide wheel 32 serves as a guide and counter-balance.

Although this invention has been described in its preferred form with a certain degree of particularity with respect to an automatic golf ball teeing device, it is understood that the present disclosure of the preferred form has been made only by way of example and that numerous changes in the details of structures and the composition of the system may be resorted to without departing from the spirit and scope of the invention.

Now that the invention has been described,

What is claimed is:

1. A golf ball teeing device, comprising:

a housing coupled to a base;

a hopper, having an open top portion and an opening in a lower portion, said hopper sized to accommodate a plurality of balls, said hopper connected to said housing;

a ball delivery tube, said ball delivery tube having a first end and a second end, wherein said first end of said ball delivery tube is connected to said opening in the lower portion of said hopper, said ball delivery tube being sloped such that the second end of said ball delivery tube is lower than said first end of said ball delivery tube;

an actuating mechanism for moving a ball placement mechanism between a first position and a second position, said actuating mechanism comprising:

(a) a guide element fixed to said housing;

(b) a primary lever having distal end and a proximal end, said proximal end being pivotably mounted to said guide element, said lever capable of pivoting about an axis defined by said guide element between a rest position and an operating position; and (c) a secondary lever having a distal and a proximal end, said proximal end of said secondary lever connected to said proximal end of said primary lever, said secondary lever being capable of pivoting between a rest position and an operating position, said distal end of said secondary lever having a slot defined therein; and said a ball placement mechanism comprising:

(a) first and second elongate members oriented parallel to one another, wherein said first elongate member is operatively associated with said secondary lever such that pivoting of said first and second levers between said rest position and said operating position causes said first elongate member to slide between a rest position and an operating position;

(b) stop guides slidably mounted upon and joining said first and second elongate members to maintain the spatial relationship between the first and second elongate members;

(c) a ball receptacle member including a proximal end pivotally hinged to the first elongate member and pivotally hinged to said second elongate member, said pivotal hinges being spatially separated, and a distal end for receiving a golf ball;

(d) a partition fixed to said first elongate member, which partition covers said second opening of said ball dispensing tube to prevent dispensing of golf balls when said lever is not in the rest position and which uncovers said second opening of said ball dispensing tube to permit dispensing of golf balls when said lever is in the rest position;

wherein pivoting said first lever and sliding said first elongate member from said rest position to said operating position causes said partition, said second elongate member, and said ball receptacle member to slide from resting positions to operating positions, and wherein sliding said first elongate member from said operating position to said resting position causes said ball receptacle member to first pivot downwards, then to retract towards said rest position and to cause said second elongate member to return to said rest position.

2. A golf ball teeing device as in claim 1, wherein said ball receptacle member includes:

a horizontal crescent shaped ball cup coupled at the distal end of said ball receptacle member, wherein said crescent shaped ball cup is sized to cradle a golf ball.

3. A golf ball teeing device as in claim 2, wherein said crescent shaped ball cup includes two prongs which cradle a golf ball in said crescent shaped ball cup.

4. A golf ball teeing device, comprising:

a housing coupled to a base, a hopper, having a top portion and a lower portion, sized to accommodate a plurality of balls said hopper connected to said housing, a ball delivery tube, having a first end and a second end, wherein said first end is connected to the lower portion of said hopper, said ball delivery tube is angled slightly to the horizontal such that the second end of said ball delivery tube is lower than said first end of said ball delivery tube, an actuating mechanism for releasing a golf ball from the ball delivery tube onto a ball placement mechanism, said actuating mechanism comprising a primary lever, one end of which is pivotably mounted to a guide bearing surface, said guide bearing surface coupled to said housing, said lever capable of pivoting between a rest position and an operating position;

a secondary lever, having a distal and a proximal end, said proximal end connected to said primary lever, which pivots within said guide bearing surface, said secondary lever being capable of pivoting between a rest position and an operating position, wherein a slot is formed through the distal end of the second lever;

first and second elongate members, oriented parallel to one another, wherein said first elongate member is coupled to said secondary lever, the movement of said first and second levers from a rest position to an operating position acts upon said first elongate member which serves as the driving mechanism for the ball placement mechanism, wherein to maintain the spatial relationship between the first and second elongate members stop guides are slidably mounted upon the elongate members;

a means for biasing the ball placement mechanism coupled to said second elongate member, a ball placement mechanism, said ball placement mechanism comprising a housing defining a channel which surrounds said first and second elongate members, wherein said housing has a solid top portion and a groove defined therein; and a ball receptacle, which is pivotally hinged at the distal end to the first elongate member, and coupled to the channel at an upper fixed pivot point, wherein said ball placement receptacle further comprises a crescent shaped ball cup coupled to the distal end of said ball receptacle, wherein said crescent shaped ball cup defines a opening through the center of said ball cup sized to cradle a golf ball, upon actuation of said primary lever said ball placement mechanism is impelled forward, as said ball placement mechanism moves beyond center of the guide bearing surface to a fully extended position said biasing means retracts said ball placement mechanism, this rearward motion causes said ball receptacle to pivot downward and dispense a golf ball onto a tee.

5. A golf ball teeing device as in claim 4, wherein as said ball placement mechanism is retracted the ball receptacle rotates about an upper fixed pivot point mounted through said channel, as the ball receptacle pivots downward said ball cup disengages from a golf ball.

6. A golf ball teeing device as in claim 4, wherein said golf ball teeing device further comprises guide wheels affixed to said housing for guiding said housing.

7. A golf ball teeing device as in claim 4, wherein said guide wheels support and counterbalance said ball placement mechanism within said housing.

8. A golf ball teeing device as in claim 4, wherein said base further comprises a slot defined therein sized to accommodate a golf tee.

9. A golf ball teeing device as in claim 4, wherein said golf teeing device further comprises a mat coupled with said base.

10. A method for driving a golf ball from an golf teeing device by a golfer, said method comprising the steps of:

(a) providing a golf ball teeing device, said golf teeing device comprising:

a housing coupled to a base, a hopper, having a top portion and a lower portion, sized to accommodate a plurality of balls said hopper connected to said housing, a ball delivery tube, having a first end and a second end, wherein said first end is connected to the lower portion of said hopper, said ball delivery tube is angled slightly to the horizontal such that the second end of said ball delivery tube is lower than said first end of said ball delivery tube, an actuating mechanism for releasing a golf ball from the ball delivery tube onto a ball placement mechanism, said actuating mechanism comprising a primary lever, one end of which is pivotably mounted to a guide bearing surface, said guide bearing surface coupled to said housing, said lever capable of pivoting between a rest position and an operating position;

a secondary lever, having a distal and a proximal end, said proximal end connected to said primary lever, which pivots within said guide bearing surface, said secondary lever being capable of pivoting between a rest position and an operating position, wherein a slot is formed through the distal end of the second lever;

first and second elongate members, oriented parallel to one another, wherein said first elongate member is coupled to said secondary lever, the movement of said first and second levers from a rest position to an operating position acts upon said first elongate member which serves as the driving mechanism for the ball placement mechanism, wherein to maintain the spatial relationship between the first and second elongate members stop guides are slidably mounted upon the elongate members;

a means for biasing the ball placement mechanism coupled to said second elongate member, and a ball placement mechanism, said ball placement mechanism comprising a channel which surrounds said first and second elongate members, wherein said channel has a solid top portion and a groove defined therein; and a ball receptacle, which is pivotally hinged at the distal end to the first elongate member, and coupled to the channel at an upper fixed pivot point, (b) inserting a golf tee into a slot defined in said base, (c) taking a stance behind the ball and addressing the ball, (d) the golfer extending the distal end of his golf club and depressing the primary lever which extends through said housing, (e) driving the golf ball which has been dispensed onto the tee.

* * * * *